US005265000A

United States Patent [19]

Lin

[11] Patent Number: 5,265,000

[45] Date of Patent: Nov. 23, 1993

[54] TELESCOPIC AND COLLAPSIBLE DESK LAMP

[76] Inventor: Jack Lin, 4F, No. 112, Wen Lin N. Rd., Taipei, Taiwan

[21] Appl. No.: 976,842

[22] Filed: Nov. 16, 1992

[51] Int. Cl.[5] ..... F21S 1/12

[52] U.S. Cl. ..... 362/413; 362/419; 362/427; 362/450

[58] Field of Search ..... 362/410, 413, 414, 419, 362/427, 431, 450

[56] References Cited

U.S. PATENT DOCUMENTS

| | | | |
|---|---|---|---|
| 4,453,204 | 6/1984 | Warshawsky | 362/427 |
| 4,772,993 | 9/1988 | Engel | 362/414 |
| 5,012,394 | 4/1991 | Woodward | 362/413 |
| 5,101,332 | 3/1992 | Hsia | 362/413 |
| 5,141,325 | 8/1992 | Huang | 362/413 |
| 5,176,443 | 1/1993 | Lin | 362/413 |

*Primary Examiner*—Richard R. Cole
*Assistant Examiner*—Alan B. Cariaso
*Attorney, Agent, or Firm*—Lowe, Price, LeBlanc & Becker

[57] ABSTRACT

A telescopic and collapsible desk lamp is disclosed having a lamp shade pivotally connected to a telescopic support supported on a cylindrical stand, wherein the telescopic support is consisted of two telescopic metal tubes pivotally connected to two metal mounting tubes fastened to the cylindrical stand by angle brackets. The lamp shade is turned upside-down and covered over the cylindrical stand at the top as the telescopic metal tubes are respectively received inside the metal mounting tubes. An insulative link is detachably connected between the telescopic metal tubes to prevent short circuit.

1 Claim, 5 Drawing Sheets

TELESCOPIC AND COLLAPSIBLE DESK LAMP

BACKGROUND OF THE INVENTION

The present invention relates to desk lamps and relates more particularly to a telescopic and collapsible desk lamp which can be collapsed to reduce its storage space for a delivery.

Various desk lamps are known and designed for use on a desk or table. A desk lamp generally has a support mounted on a stand to hold a lamp shape and a lamp bulb or tube. In designing a desk lamp, many factors shall be taken into account, for example, the stability of the stand, the outer appearance, the convenience in adjusting the projecting angle of the lamp bulb or tube, the collapsibility, . . . etc. However, it is not easy to find a desk lamp from the market which satisfies these requirements.

SUMMARY OF THE INVENTION

It is one object of the present invention to provide a desk lamp which can be conveniently collapsed to reduce its storage space. It is another object of the present invention to provide a desk lamp which can be conveniently adjusted to any of a variety of projecting angles. It is still another object of the present invention to provide desk lamp which can be conveniently adjusted to the desired height within the range of the support thereof. It is still another object of the present invention to provide a desk lamp which causes a sense of beauty.

According to the preferred embodiment of the present invention, the desk lamp is comprised of a telescopic metal support supported on a cylindrical stand to hold a lamp shade. The lamp shade is pivotally connected to the telescopic metal support by two pivots. The telescopic metal support is consisted of two telescopic metal tubes pivotally and respectively connected to two sliding axles inserted in two mounting tubes fastened to the cylindrical stand by two pairs of angle brackets. The two telescopic metal tubes are joined in parallel with each other by an insulative link, which prevents a short circuit. As the insulative link was removed from the telescopic support, the telescopic metal tubes are respectively received inside the mounting tubes and then the lamp shade is turned upside-down on the telescopic support and covered over the cylindrical stand at the top, and therefore the total size of the desk lamp is minimized.

DETAILED DESCRIPTION OF THE PREFERRED EMBODIMENT

Figure 1:
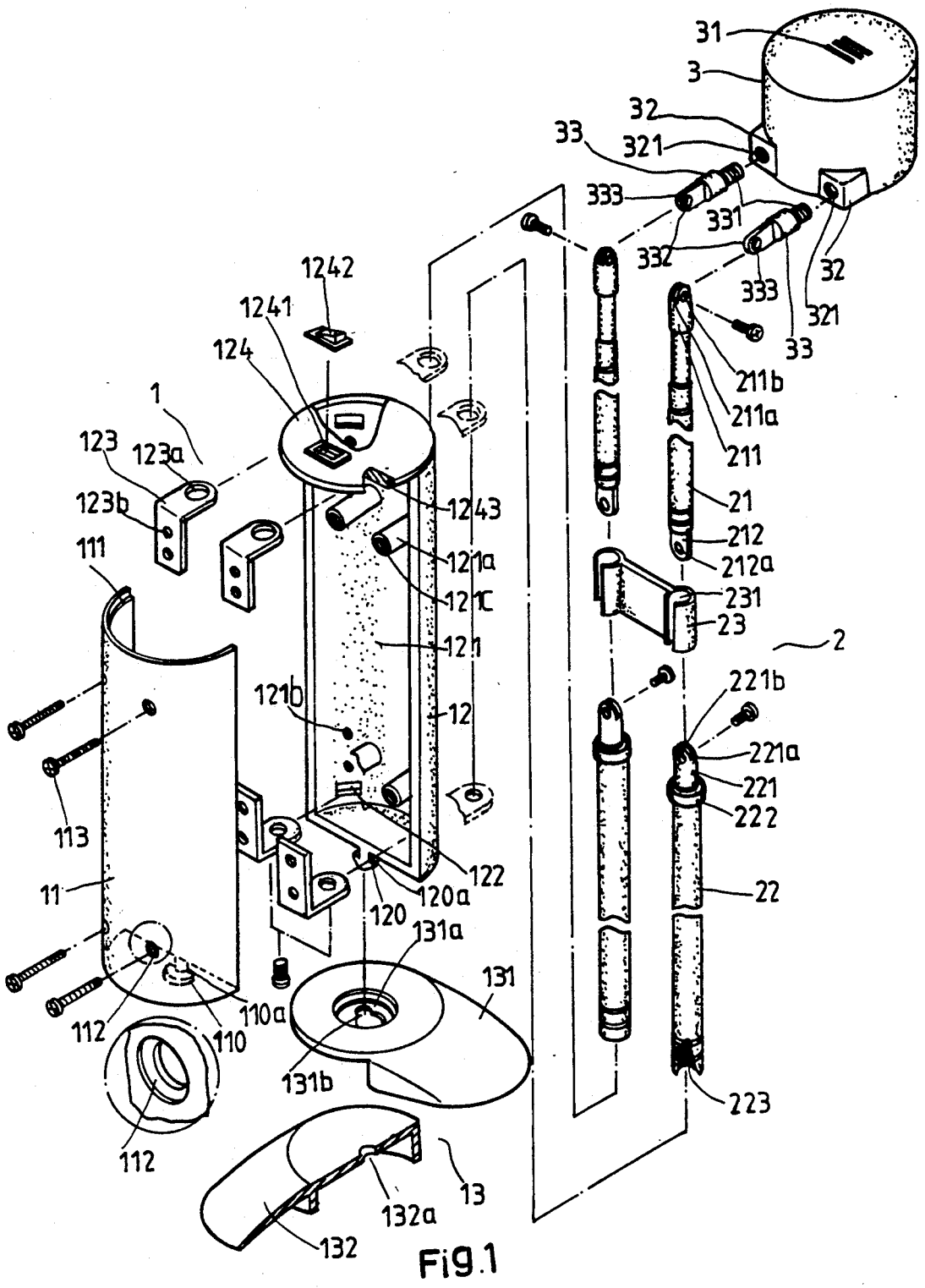
FIG. 1 is an exploded view of a desk lamp embodying the present invention.
Figure 2:
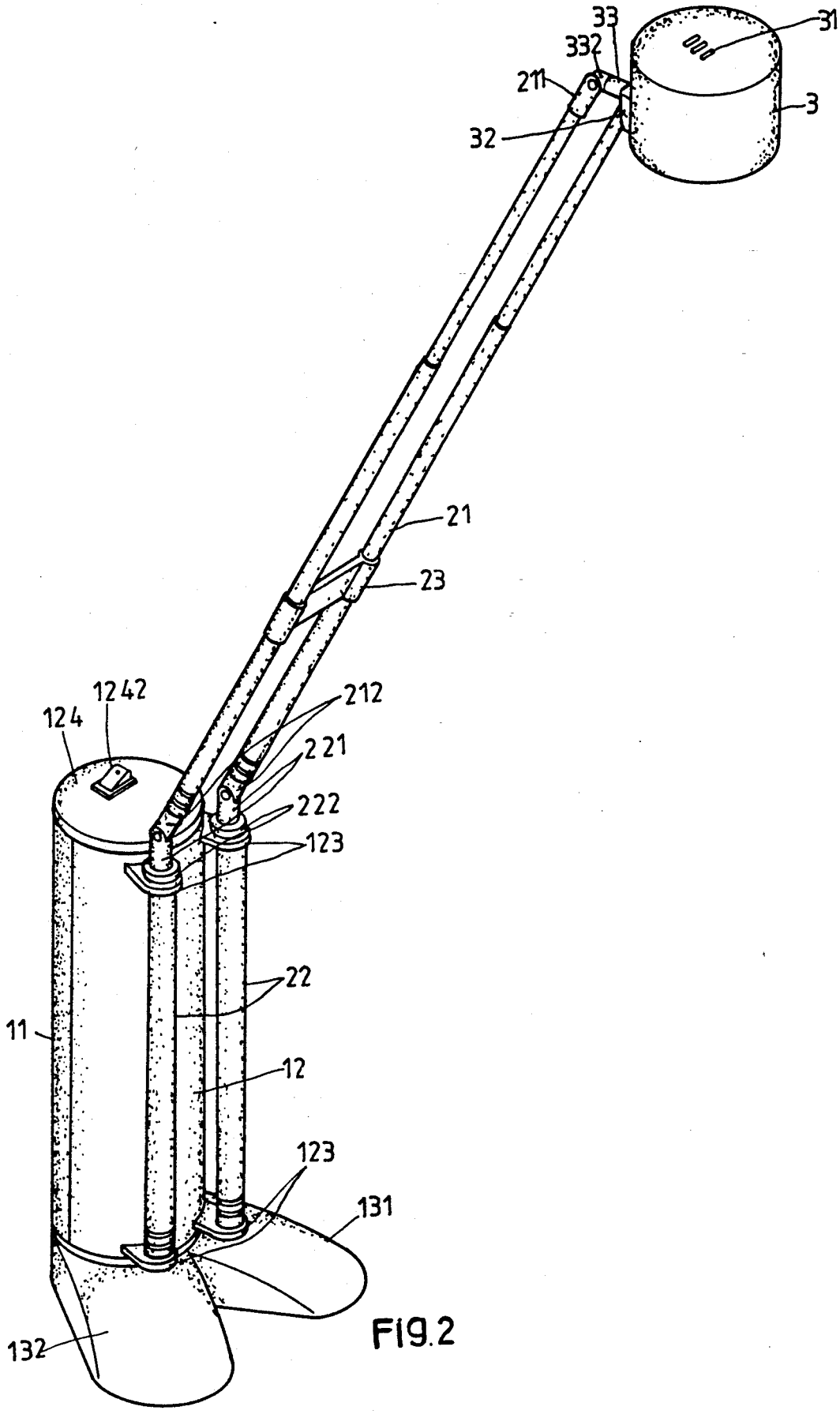
FIG. 2 is an elevational view thereof.

Referring to FIGS. 1, 2, 3 and 4, a telescopic and collapsible desk lamp as constructed in accordance with the present invention is generally comprised of a telescopic support 2 supported on a stand 1 to hold a lamp shade 3. The stand 1 is comprised of a cylindrical casing consisted of two opposing half shells 11, 12 supported on a base 13. The left half shell 11 has an inside step 111 on the top, pairs of countersunk holes 112 at suitable locations, and a bottom rod 110 with neck 110*a*. The right half shell 12 has screw holes 121*c* on projecting columns 121*a* inside a longitudinal chamber 121 thereof respectively connected to the countersunk holes 112 on the left half shell 11 by screws 113, a bottom rod 120 with neck 120*a* attached to the bottom rod 110 on the left half shell 11 and retained in a hole 131*b* through a circular recess 131*a* on a right base plate 131 and a semi-circular hole 132*a* on a left base plate 132 of the base 13 by means of the necks 110*a* and 120*a*, a step 1243 on a unitary top cover 124 thereof fitted over the top step 111 on the left half shell 11, a hole 1241 on the top cover 124 to hold a toggle switch 1, two pairs of spaced slots 122 through the peripheral wall thereof at two opposite ends through which two pairs of angle brackets 123 are inserted respectively. The angle brackets 123 have each a through hole 123*a* on one end extended out of the stand 1 through either slot 122 and a set of screw holes 123*b* on an opposite end respectively fastened to respective screw holes 121*b* on the right half shell 12 on the inside by screws. The base 13 is comprised of two parts, namely, the left base plate 132 and the right base plate 131. The telescopic support 2 is comprised of a pair of 4-section metal tubes connected to the lamp shade 3 by two connecting pivots 33. Each 4-section metal tube of the telescopic support 2 is consisted of a mounting tube 22 fastened to the stand 1, and a 3-section telescopic tube 21 pivoted to the respective mounting tube 22. The 3-section telescopic tube 21 has a screw hole 212*a* through a bottom connecting end 212 inserted in a top slot 221*a* on a sliding connecting axle 221 of the respective mounting tube 22 and pivotally connected to two opposite screw holes 221*b* thereof by a respective screw, and therefore the bottom connecting end 212 and the sliding connecting axle 221 form into a toggle joint for permitting the 3-section telescopic tube 21 to be pivoted on the respective mounting tube 22. Each connecting pivot 33 has a screw rod 331 on one end threaded into a screw hole 321 on a respective block 32 on the lamp shade 3 and a screw hole 333 through a connecting blade 332 on an opposite end inserted in a top slot 211*a* on a top connecting end 211 of the respective 3-section telescopic tube 21 and pivotally connected to two opposite screw holes 211*b* thereof by a respective screw, and therefore the connecting blade 332 and the top connecting end 211 form into a toggle joint for permitting the connecting pivot 33 to be pivoted on the respective 3-section telescopic tube 21. The mounting tube 22 is inserted through the through hole 123*a* on each of either pair of angle brackets 123, having an outward flange 222 around the top edge thereof stopped above the respective top angle bracket 123 and a screw hole 223 on the bottom end fastened to the through hole 123*a* on the respective bottom angle bracket 123 by a screw. Furthermore, vent holes 31 may be made on the top of the lamp shade 3 for dissipating heat. When assembled, the two 4-section metal tubes of the telescopic support 2 may be joined by an insulative link 23. The insulative link 23 has two parallel sockets 23 on two opposite ends thereof, which receive the two 4-section metal tubes of the telescopic support 2 respectively. The arrangement of the insulative link 23 prevents the two 4-section metal tubes of the telescopic support 2 from connecting to each other in causing a short circuit.

Referring to FIG. 1 again, the lamp bulb, namely, the lamp shade 3 can be adjusted to the desired angle by turning the connecting pivots 33 on the telescopic support 2 and/or turning the two 3-section telescopic tubes 21 on the two mounting tubes 22.

Figure 3:
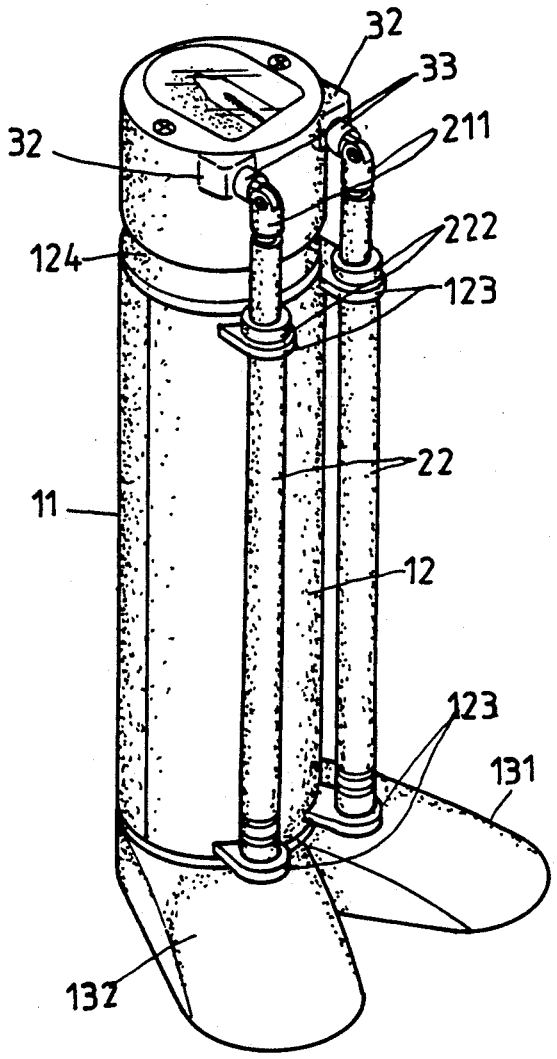
FIG. 3 illustrates the desk lamp collapsed.
Figure 4:
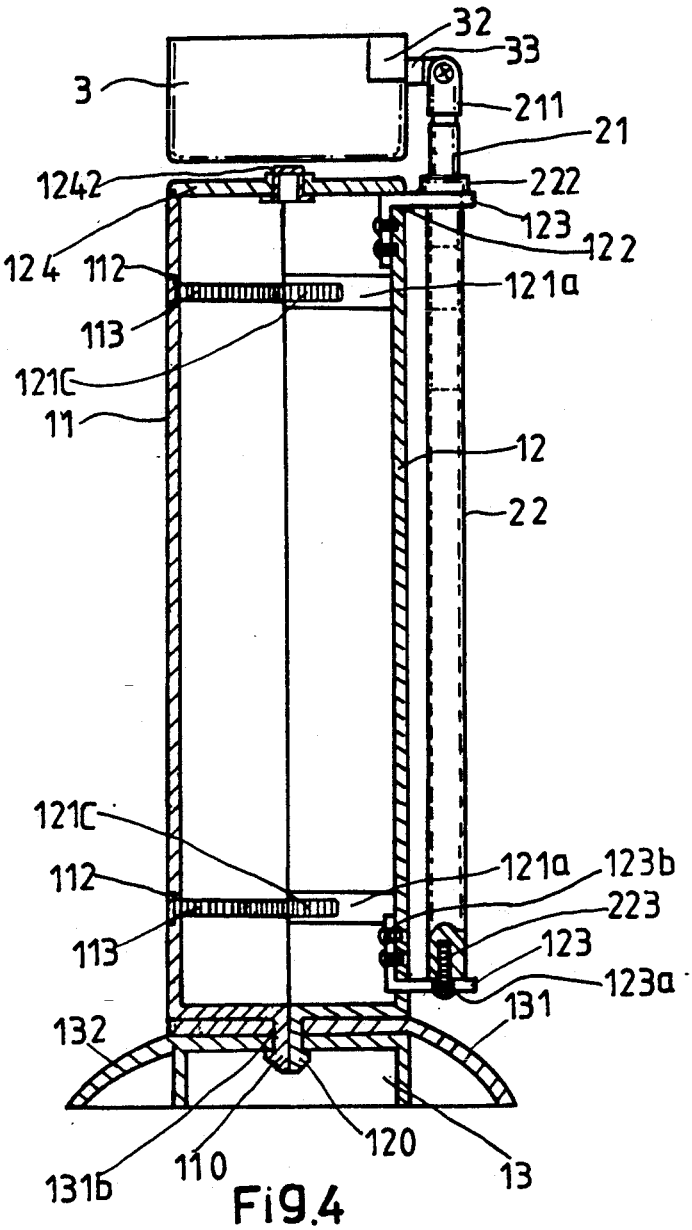
FIG. 4 is a sectional side view of the desk lamp collapsed.
Figure 5:
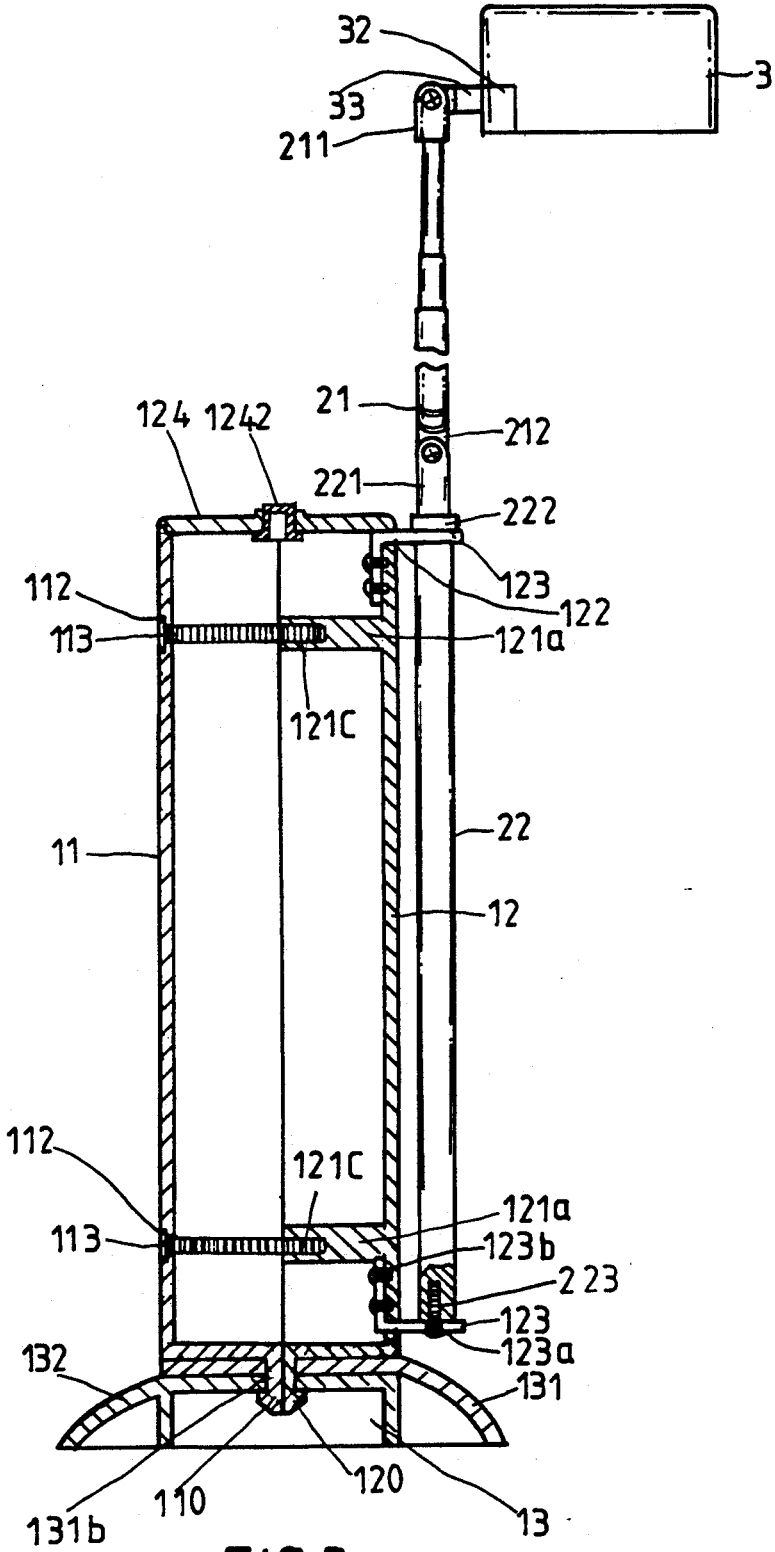
FIG. 5 is another sectional side view showing the lamp shade lifted from the stand.

Referring to FIG. 5 and FIG. 4 again, the desk lamp can be collapsed by removing the insulative link 23 from the telescopic support 2 and receiving each 3-section telescopic tube 21 inside the mounting tube 22 and then turning the connecting pivots 33 on the telescopic support 2 for permitting the lamp shade 3 to be turned upside-down and covered over the top cover 124 of the right half shell 12 of the stand 1 (see FIG. 3).

What is claimed is:

1. A telescopic and collapsible desk lamp comprising a telescopic support having one fastened to a stand and an opposite end coupled with a lamp shade through toggle joints to hold a lamp bulb, wherein:

said stand is comprised of a cylindrical casing consisted of a left half shell and a right half shell and supported on a base, and two pairs of angle brackets bilaterally fastened to said right half shell at two opposite ends to hold said telescopic support, said left half shell having an inside step on the top, pairs of countersunk holes respectively fastened to internally projecting columns on said right half shell by screws, and a bottom rod with neck side-matched to a bottom rod with neck on said right half shell and retained in a hole on said base, said right half shell having a step on a unitary top cover fitted over the top step on said left half shell, a hole on the top cover to hold a toggle switch, and two pairs of spaced slots near to two opposite ends thereof, each angle bracket having a through hole on one end extended out of either slot on said right half shell to hold said telescopic support and at least one screw hole on an opposite end respectively fastened to a respective screw hole on said right half shell on the inside by a respective screw, said base comprising a right base plate and a left base plate connected together by the bottom rods of said left and right half shells;

said lamp shade comprises two screw holes on two bottom blocks thereof respectively connected to said telescopic support by two connecting pivots, and vent holes on a top wall thereof for dissipating heat;

said telescopic support is comprised of a pair of 4-section metal tubes releasably joined in parallel with each other by an insulative link and respectively connected to said bottom blocks of said lamp shade by said connecting pivots, each 4-section metal tube being consisted of a mounting tube fastened to either pair of angle brackets on said stand and a 3-section telescopic tube pivoted to the respective mounting tube, the 3-section telescopic tube having a screw hole through a bottom connecting end thereof inserted in a top slot on a sliding connecting axle of the respective mounting tube and pivotally secured in place by a respective screw, each connecting pivot having a screw rod on one end thereof threaded into the screw hole on either bottom block of said lamp shade and a screw hole through a connecting blade on an opposite end thereof inserted in a top slot on a top connecting end of the respective 3-section telescopic tube and pivotally secured in place by a respective screw, each mounting tube being inserted through the through hole on each of either pair of angle brackets and having an outward flange around a respective top edge stopped above one of either pair of angle brackets and a screw hole on a respective bottom end fastened to the through hole on the other of the same pair of angle brackets by a screw.

* * * * *